US011079078B2

(12) United States Patent
Wang

(10) Patent No.: US 11,079,078 B2
(45) Date of Patent: Aug. 3, 2021

(54) KIT INCLUDING BENDABLE REFLECTIVE CANOPY FOR ASSEMBLING A LUMINAIRE AND METHOD OF ASSEMBLING THEREOF

(71) Applicant: SIGNIFY HOLDING B.V., Eindhoven (NL)

(72) Inventor: Lee LJ Wang, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/610,566

(22) PCT Filed: Apr. 26, 2018

(86) PCT No.: PCT/EP2018/060696
§ 371 (c)(1),
(2) Date: Nov. 4, 2019

(87) PCT Pub. No.: WO2018/202530
PCT Pub. Date: Nov. 8, 2018

(65) Prior Publication Data

US 2020/0149694 A1 May 14, 2020

(30) Foreign Application Priority Data

May 4, 2017 (CN) ..... PCT/CN2017/083040
Jun. 13, 2017 (EP) ..... 17175663

(51) Int. Cl.
*F21S 8/02* (2006.01)
*F21V 7/18* (2006.01)
(Continued)

(52) U.S. Cl.
CPC ..... *F21S 8/026* (2013.01); *F21V 5/00* (2013.01); *F21V 7/0016* (2013.01); *F21V 7/18* (2013.01);
(Continued)

(58) Field of Classification Search
CPC ..... F21V 7/0008; F21V 7/0016; F21V 7/005; F21V 7/18; F21V 17/00; F21V 17/007;
(Continued)

(56) References Cited

U.S. PATENT DOCUMENTS 6,561,678 B2 5/2003 Loughrey
2010/0182782 A1 7/2010 Ladewig
2010/0321919 A1* 12/2010 Yang ..... F21S 8/00 362/84
2011/0096544 A1 4/2011 Nakamura
(Continued)

FOREIGN PATENT DOCUMENTS

DE 20313899 U1 12/2003
KR 20120106415 A 9/2012
(Continued)

*Primary Examiner* — Rajarshi Chakraborty
*Assistant Examiner* — Steven Y Horikoshi
(74) *Attorney, Agent, or Firm* — Daniel J. Piotrowski

(57) ABSTRACT

Provided is a kit for assembling a luminaire comprising a bendable reflective canopy and a plurality of frame sections which define a frame and a light exit window of the luminaire. The frame sections include a pair of opposing side sections with an engagement member and side sections. The reflective canopy comprises a pair of opposing edge portions, each edge portion engaging with one of the engagement members when assembling the luminaire. The opposing side sections are spaced by the further side sections such that the reflective canopy is bent when the edge portions are engaged with the engagement members so as to cause the reflective canopy to arch over the light exit window. Solid state lighting elements are mounted on one of the side sections such that at least a part of the light emitted is redirected by the arched reflective canopy towards the light exit window.

13 Claims, 7 Drawing Sheets

(51) Int. Cl.

| | |
|---|---|
| ***F21V 5/00*** | (2018.01) |
| ***F21V 13/04*** | (2006.01) |
| ***F21V 17/16*** | (2006.01) |
| ***F21V 7/00*** | (2006.01) |
| *F21Y 115/10* | (2016.01) |
| *F21Y 103/10* | (2016.01) |

(52) U.S. Cl.
CPC ..... *F21V 13/04* (2013.01); *F21V 17/164* (2013.01); *F21Y 2103/10* (2016.08); *F21Y 2115/10* (2016.08)

(58) Field of Classification Search
CPC ..... F21V 17/10; F21V 17/104; F21V 17/164; G02B 6/0096; F21S 8/026
See application file for complete search history.

(56) References Cited

U.S. PATENT DOCUMENTS

| | | | | |
|---|---|---|---|---|
| 2013/0294053 | A1 | 11/2013 | Marquardt et al. | |
| 2014/0268715 | A1* | 9/2014 | Boyer ..... | F21V 7/0008 362/217.05 |
| 2014/0268721 | A1 | 9/2014 | Durkee et al. | |
| 2014/0268747 | A1* | 9/2014 | Demuynck ..... | F21S 8/026 362/235 |
| 2016/0116118 | A1 | 4/2016 | Bernard et al. | |
| 2016/0305619 | A1 | 10/2016 | Howe | |
| 2017/0009942 | A1 | 1/2017 | Myers et al. | |

FOREIGN PATENT DOCUMENTS

| | | | |
|---|---|---|---|
| KR | 101191218 | B1 | 10/2012 |
| KR | 20150056226 | A | 5/2015 |

* cited by examiner

KIT INCLUDING BENDABLE REFLECTIVE CANOPY FOR ASSEMBLING A LUMINAIRE AND METHOD OF ASSEMBLING THEREOF

CROSS-REFERENCE TO PRIOR APPLICATIONS

This application is the U.S. National Phase application under 35 U.S.C. § 371 of International Application No. PCT/EP2018/060696, filed on Apr. 26, 2018, which claims the benefit of International Application No. PCT/CN2017/083040, filed on May 4, 2017. These applications are hereby incorporated by reference herein.

FIELD OF THE INVENTION

This invention relates to a kit for assembling a luminaire, a method of assembling the luminaire using the kit, and a modular ceiling comprising the kit or the assembled luminaire.

BACKGROUND OF THE INVENTION

Solid state lighting elements, such as LEDs, are being increasingly employed in luminaires due to the advantages they offer in terms of energy efficiency and longevity. Such devices may also offer further advantages derived from the configurable nature of their luminous output. For example, the dimming level, colour temperature and/or colour point of the luminous output of solid state lighting elements may be adjusted. This has resulted in development of intelligent luminaires in which solid state lighting elements are employed in combination with one or more sensors and/or controllers for configuring the luminous output provided by the solid state lighting elements.

One of the drawbacks of solid state lighting elements is related to the nature of the light profile which they provide. Solid state lighting elements may be considered as approximate point light sources which emit intensely from a small emissive area. Thus if (emitting) solid state lighting elements are viewed directly, significant glare may be experienced by the observer. This issue of glare has necessitated incorporation of particular features into luminaire designs such as panel-luminaire (troffer) designs; an example of such a panel-luminaire design is shown in FIG. 1.

The left hand pane of FIG. 1 is a view of the exterior of the panel-luminaire 50. The luminaire 50 comprises a light exit portion 52 surrounded by a housing or frame 54. The right hand pane of FIG. 1 shows part of the interior of the luminaire 50. The inside of the luminaire comprises a pattern of solid state lighting elements 56 which are arranged to emit light directly towards the light exit portion 52. This panel-luminaire 50 is often termed an 'up-down' luminaire owing to the direct emanation of light from the light source, i.e. the solid state lighting elements, down into a space situated beneath the light exit portion.

However, in order to avoid darker areas between the solid state lighting elements 56 being visible, the solid state lighting elements 56 must be arranged in a dense pattern. This necessitates using larger numbers of solid state lighting elements 56 which may mean that the maximum luminous flux which the luminaire is capable of producing is much larger than is actually required for most lighting applications. For this reason, the solid state lighting elements 56 are usually operated at low currents in order to avoid the luminous flux delivered by the luminaire being greater than desired. Up-down luminaires also tend to require additional design features, such as a diffuser for providing a more even illumination emanating from the up-down luminaire 50. Importantly, the diffuser also serves to reduce glare by partially scattering the intense light emitted by each of the solid state lighting elements 56 before it exits the up-down luminaire 50.

The problem of glare may be alternatively addressed by an 'indirect' luminaire (not shown). In such a design, the solid state lighting elements are mounted to illuminate a reflective surface which redirects the light (originally) emitted from the solid state lighting elements towards the light exit portion. In such indirect luminaires, the solid state lighting elements often face the reflective surface such that the redirected light from reflective surface is partially blocked from exiting the luminaire by the solid state lighting elements themselves, the carriers on which the solid state lighting elements are mounted, and any other features of the design lying between the reflective surface and the light exit portion. This reduces the luminous efficiency of the indirect luminaire and can result in visible 'darker' areas corresponding to the solid state lighting elements and carriers which diminish the aesthetic appeal of the lighting effect provided by the indirect luminaire. The latter may be partly addressed by the light exit portion including a diffuser but this necessitates the addition of a further component to the indirect luminaire design which increases the overall cost of the luminaire, including its packaging and transportation.

A cross-section of a further prior-art luminaire design which provides indirect lighting but which avoids the issue of the solid state lighting elements and carriers blocking light from exiting the luminaire is schematically depicted in FIG. 2. This 'side-lit' luminaire 70 comprises solid state lighting elements 56 which are mounted around the perimeter of the light exit portion 52 and arranged to emit light laterally towards a centrally positioned light guide 58. The light guide 58 guides the light emitted by the solid state lighting elements 56 towards the light exit portion 52, as shown in FIG. 2 by the hashed arrows between the light guide 58 and the light exit portion 52. Light is also guided towards a reflector 60, as shown by the hashed arrows between the light guide 58 and the reflector 60, which redirects light towards the light exit portion 52. The various components of the side-lit luminaire 70 are contained within a housing 54.

However, the side-lit luminaire 70 suffers from disadvantages associated with its more elaborate design, e.g. in relation to the up-down luminaire 50. The multi-component nature of its design means that it is more costly than, for instance, the up-down luminaire 50 both in terms of its manufacture and its transportation to suppliers and end users. In particular, the complexity of the design means that the luminaire must be assembled before being transported to end users. This requirement presents difficulties in terms of efficient storage and transportation of the side-lit luminaire 70, and in particular a plurality of such luminaires. High packaging costs for such a side-lit luminaire 70 also remain a problem.

SUMMARY OF THE INVENTION

The present invention seeks to provide a side-lit luminaire which may be transported or stored with greater ease and efficiency than conventional side-lit luminaires.

The invention is defined by the claims.

In accordance with an aspect, there is provided a kit for assembling a luminaire by an end user, comprising: a bendable reflective canopy extending between a pair of opposing edge portions; a plurality of frame sections for defining a frame delimiting a light exit window of the luminaire, the frame sections including a pair of opposing side sections and a pair of further side sections for spacing the opposing side sections, each of the opposing side sections comprising an engagement member for engaging with one of the edge portions when assembling the luminaire, wherein the opposing side sections are spaced by the further side sections such that the reflective canopy arches over the light exit window when the edge portions are engaged with the engagement members; and a plurality of solid state lighting elements, wherein each solid state lighting element is mounted on one of the side sections such that when the luminaire is assembled at least a part of its luminous output is redirected by the bendable reflective canopy towards the light exit window.

The present invention provides a kit for assembling a luminaire which provides an indirect lighting effect, i.e. by redirection or reflection of the light emitted by the solid state lighting elements by the bendable reflective canopy towards the light exit window. The positioning of the solid state lighting elements in the frame means that the solid state lighting elements themselves do not lie in the optical path of light which has been reflected by the reflective canopy towards the light exit window.

Importantly, the luminaire has a simpler design compared to conventional side-lit luminaires which means that the end user can be supplied the luminaire in the form of a kit which is straightforward to assemble. The fact that the luminaire can be supplied as a kit means that the luminaire can be more efficiently stored and transported. The smaller form factor of the kit compared to the assembled luminaire may also mean that less packaging is required with associated environmental and cost benefits.

Each solid state lighting element may be arranged such that, when the luminaire is assembled, a first part of its luminous output is redirected by the bendable reflective canopy towards the light exit window, and a second part of its luminous output is aimed at the light exit window. Accordingly, the luminaire may provide both direct, i.e. without reflection, and indirect lighting effects.

The kit may further comprise a pair of end panels, each end panel being shaped to cover a gap delimited by one of the further side sections and an arcuate edge of the arched reflective canopy when the luminaire is assembled, preferably wherein the end panels are translucent or opaque. The end panels may support the arched shape of the reflective canopy when the luminaire is assembled.

In an embodiment, the luminaire may be a troffer and the frame and arched reflective canopy may be dimensioned to fit into a ceiling recess when the luminaire is assembled. In this embodiment, the end panels may also serve to prevent users from observing the plenum area above the suspended ceiling through the aforementioned gap.

Each end panel may comprise one of the further side sections. In other words, the frame may not be supplied in the kit as a fixed, or pre-assembled, frame but rather the frame is assembled by the end user. This assembly of the frame may involve fixing the opposing side sections to the further side sections which are included in the end panels.

By supplying the frame as frame sections which must be connected together by the end user in order to assemble the frame, regardless of whether or not the end panels include the further side sections, the kit may be more efficiently packaged and transported.

In alternative embodiments, the plurality of frame sections may define a fixed frame.

The engagement member may be a fastening member, each edge portion further comprising a further fastening member for engaging with one of the fastening members. Accordingly, the engagement members may be such as to fasten or secure the respective edge portions to the frame. In an embodiment, the further fastening member may comprise at least one protrusion which protrudes from the edge portion, with the fastening member comprising an elongate channel dimensioned to receive one of the edge portions, and a hooked member opposing the channel for receiving and securing the at least one protrusion when the edge portion is received in the elongate channel.

The solid state lighting elements may be grouped in at least one row, each row extending across one of the side sections. In this way, the solid state lighting elements may be arranged in a spatially efficient manner and the luminaire may provide the desired luminous output and uniformity of lighting. The frame may comprise an optical element mounted over each of the rows; the optical element may comprise a diffuser strip or a lens strip. The lens strip may assist to guide, i.e. refract, light emitted by the solid state lighting elements towards the bendable reflective canopy. The diffuser strip may assist to combine and homogenize the luminous output of each of the solid state lighting elements such that a uniform lighting effect is attained across the row.

The bendable reflective canopy may be supplied to the end user in an unbent state, i.e., a substantially flat state.

The bendable reflective canopy may comprise a plurality of spatially separated bendable support ribs for supporting the canopy, each of the support ribs extending between the pair of opposing edge portions. The bendable support ribs may assist to reinforce the reflective canopy such that it can better withstand the bending required to form the aforementioned arched shape when the luminaire is assembled.

In accordance with another aspect there is provided a method of assembling a luminaire using the kit as defined above comprising: engaging an edge portion of the bendable reflective canopy with an engagement member located on a side section of the frame; bending the bendable reflective canopy such that it arches over the light exit window; and engaging a further edge portion which opposes the edge portion with a further engagement member located on a further side section which opposes the side section. In both steps of engaging as defined above, a hooked member receives and secures said at least one protrusion when the edge portion is received in said elongate channel.

In accordance with yet another aspect there is provided a luminaire assembled from the kit as defined above.

The assembled luminaire or the kit as defined above may be included in a modular ceiling kit. The modular ceiling kit may, for example, further comprise a plurality of panels and a plurality of frame elements defining a frame for suspending the panels. The luminaire(s) may form or replace at least some of the panels in order to provide ceiling lighting.

BRIEF DESCRIPTION OF THE DRAWINGS

Embodiments of the invention are described in more detail and by way of non-limiting examples with reference to the accompanying drawings, wherein.

DETAILED DESCRIPTION OF THE EMBODIMENTS

Figure 1:
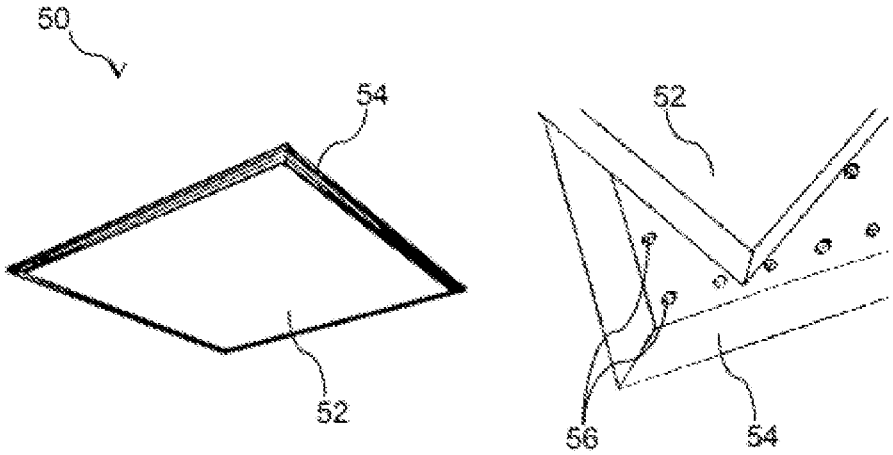
FIG. 1 Prior Art
FIG. 1 shows views of the exterior (left hand pane) and interior (right hand pane) of a known luminaire.

The invention will be described with reference to the Figures.

It should be understood that the detailed description and specific examples, while indicating exemplary embodiments of the apparatus, systems and methods, are intended for purposes of illustration only and are not intended to limit the scope of the invention. These and other features, aspects, and advantages of the apparatus, systems and methods of the present invention will become better understood from the following description, appended claims, and accompanying drawings. It should be understood that the Figures are merely schematic and are not drawn to scale. It should also be understood that the same reference numerals are used throughout the Figures to indicate the same or similar parts.

Provided is a kit for assembling a luminaire comprising a bendable reflective canopy and a plurality of frame sections which define a frame. The frame defines a perimeter of a light exit window of the luminaire. The frame sections include a pair of opposing side sections spaced by a pair of further side sections. Each of the opposing side sections comprises an engagement member. The reflective canopy comprises a pair of opposing edge portions, each edge portion engaging with one of the engagement members when assembling the luminaire. The opposing side sections are spaced by the further side sections such that the reflective canopy is bent when the edge portions are engaged with the engagement members so as to cause the reflective canopy to arch over the light exit window. The frame further comprises a plurality of solid state lighting elements. Each solid state lighting element is mounted on one of the side sections such that when the luminaire is assembled at least a part of the luminous output emitted by the solid state lighting element is redirected by the arched reflective canopy towards the light exit window.

Figure 2:
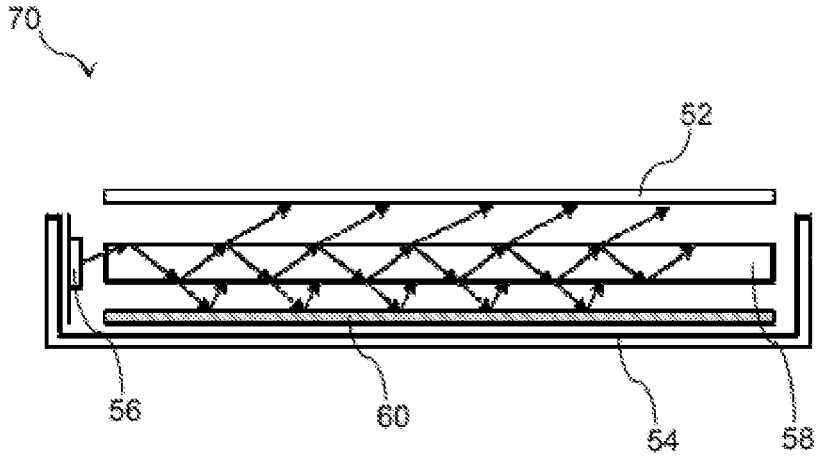
FIG. 2 Prior Art
FIG. 2 schematically depicts a cross-section of another known luminaire.

Prior art side-lit luminaire designs such as the design schematically depicted in FIG. 2 suffer from being too complicated and having too many components, e.g. relative to simpler 'up-down' luminaire designs, e.g. as depicted in FIG. 1. Accordingly, conventional side-lit luminaires require assembly before being supplied to the end user. This requirement presents difficulties in terms of efficient storage and transportation of such side-lit luminaires. High packaging costs for such side-lit luminaires are also a problem owing to this pre-assembly requirement.

The present invention provides a kit which enables assembly of a luminaire in which an indirect lighting effect is achieved, i.e. by redirection or reflection of the light emitted by the solid state lighting elements by the reflective canopy towards the light exit window. The positioning of the solid state lighting elements in the frame means that these components, and the carriers on which the solid state lighting elements may be mounted, do not themselves block light which has been reflected by the reflective canopy from exiting the light exit window.

Importantly, the luminaire according to present embodiments has a simple design which means that the end user can be supplied the luminaire as a kit which is straightforward to assemble. The fact the luminaire can be supplied as a kit means that the luminaire can be more efficiently stored and transported. The smaller form factor of the kit compared to a pre-assembled luminaire may also mean that less packaging is required with associated environmental and cost benefits.

Figure 3:
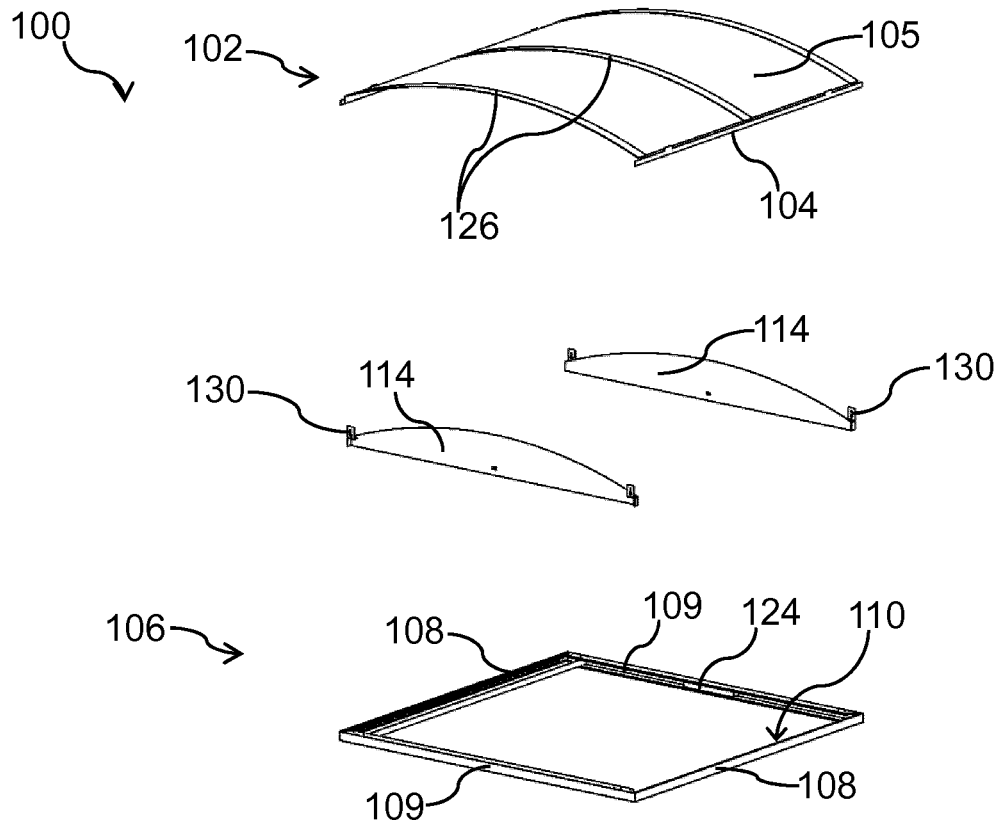
FIG. 3 shows a kit for assembling a luminaire according to an embodiment.

A kit 100 according to an embodiment is shown in FIG. 3. The kit 100 comprises a bendable reflective canopy 102 and a frame 106. Whilst the bendable reflective canopy 102 is shown in a bent state in FIG. 3, this is for the purposes of depicting the assembly of the luminaire and does not necessarily mean that the reflective canopy 102 is supplied in such a bent state. The bendable reflective canopy 102 may be supplied in an unbent state, i.e. a substantially flat state, in order to enhance the ease of storage and transportation of the kit 100. Supplying the bendable reflective canopy 102 to the end user in a substantially flat state may further decrease the quantity of packaging required for the kit 100 as will be immediately apparent to the skilled person.

Alternatively, the bendable reflective canopy 102 may be supplied in a bent state such that the step of bending the reflective canopy 102 during assembly of the luminaire is obviated.

The bendable reflective canopy 102 extends between a pair of opposing edge portions 104. In other words, the bendable reflective canopy 102 comprises the pair of opposing edge portions 104 with a reflective material 105 extending between the opposing edge portions 104. The reflective material 105 of the bendable reflective canopy 102 faces the light exit window when the luminaire is assembled in order to redirect, i.e. reflect, light emitted from the solid state lighting elements (not visible in FIG. 3) towards the light exit window.

The frame sections include a pair of opposing side sections 108 which are spaced by a pair of further side sections 109. As shown in FIG. 3, the further side sections 109 may, for instance, join the respective opposing side sections 108 at connection points defining corners of the frame 106.

The separation, i.e. the length dimension, between the edge portions 104 of the bendable reflective canopy 102 when in an unbent state, e.g. a substantially flat state, may be greater than the spacing between the opposing side sections 108 of the frame 106. For example, the length dimension may be 5-10% longer than the spacing between the side sections 108. Accordingly, in order to engage each of the edge portions 104 with the respective engagement members 110 on the opposing side sections 108, bending of the bendable reflective canopy 102 is required in order to bring the edge portions 104 sufficiently close together such that they each can be engaged with one of the engagement members 110. Thus in this bent state a linear distance between the edge portions 104 may substantially match the spacing between the opposing side sections 108.

The bending of the bendable reflective canopy 102 when assembling the luminaire may also be beneficial in terms of the lighting effect provided by the luminaire. The bending of the bendable reflective canopy 102 means that it arches over the light exit window when the luminaire is assembled. In other words, the bent reflective canopy 102 comprises an arcuate shape when the luminaire is assembled, which arcuate shape terminates at the respective edge portions 104. This arcuate shape may improve the luminous efficiency of the luminaire by permitting the bendable reflective canopy 102 to collect and redirect a greater angular proportion of the luminous distribution emanating from the solid state lighting elements than, for instance, a flat reflector. The arcuate shape may further provide a degree of shaping of the luminous output of the luminaire so as to deliver a more focused luminous flux into a space than, for instance, provided by a luminaire comprising a flat reflector.

The frame 106 is depicted in FIG. 3 as a fixed or pre-assembled frame 106. The advantage of supplying the frame 106 in an assembled state is that user-assembly of the frame 106 itself, i.e. in addition to the step of securing the bendable reflective canopy 102 to the frame 106, is obviated. This may be advantageous given that the frame 106 carries or houses the solid state lighting elements and may also include a driver 124 for regulating power supplied to the solid state lighting elements. Other electrical components may also be included in the frame 106. Accordingly, supplying a pre-assembled frame 106 may mean avoiding the placing of additional responsibility on the end user or installer for ensuring adequate and safe electrical connections are made between the respective frame sections, i.e. between the respective side sections 108, 109, when assembling the frame 106.

Alternatively, the frame 106 may be included in the kit 100 as a plurality of frame sections to be assembled by the end user. This has the advantage that the frame sections may be more efficiently and cost-effectively packaged and transported. The frame sections may be connected together by any suitable fixing components (not shown), such as clips, screws etc. The frame sections may further include suitable electrical connectors (not shown) in order to provide the requisite electrical connections between the respective side sections 108, 109. Any suitable electrical connectors may be contemplated, such as a plug and socket, crimp-on connector, etc.

The frame sections, or the fixed frame 106, may be formed of any suitable material, such as a metal (e.g. aluminium), metal alloy (e.g. steel), a polymer, or a combination of these materials. Forming the frame sections or frame 106 from a metal or metal alloy may assist in dissipation of heat from the solid state lighting elements and the driver 124, if the driver 124 is included in the frame 106. An extrudable metal such as aluminium may also mean that the frame sections or frame 106 may be fabricated by extrusion methods, which are well-known per se.

The frame 106 defines a light exit window of the luminaire and includes a plurality of solid state lighting elements which are arranged to emit at least a part of their luminous output towards the bendable reflective canopy 102 when the luminaire is assembled. An indirect lighting effect is thus provided by the arched reflective canopy 102 redirecting, i.e. reflecting, light emitted by the solid state lighting elements towards the light exit window such that the luminaire illuminates a space beyond, e.g. situated below, the light exit window. Owing to the positioning of the solid state lighting elements in the frame 106, i.e. around the perimeter of the light exit window, these components do not themselves block any of the light which is redirected by the bendable reflective canopy 102 from exiting the luminaire. This means that the positioning of the solid state lighting elements does not decrease the luminous efficiency of the luminaire and prevents the appearance of visible 'darker' regions which would otherwise be present if the solid state lighting elements were positioned in the optical path of the light between the bendable reflective canopy 102 and the light exit window.

Figure 4:
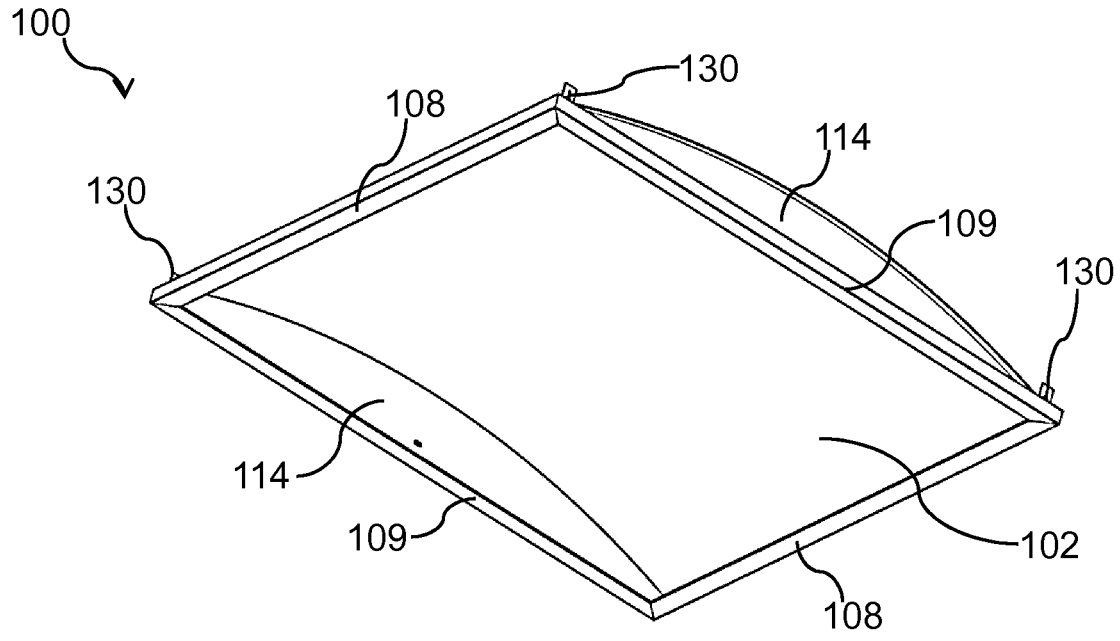
FIG. 4 shows the luminaire assembled using the kit shown in FIG. 3.

In an embodiment, the kit 100 further comprises a pair of end panels 114. As shown in FIG. 4, each end panel 114 may cover a gap delimited by one of the further side sections and an arcuate edge of the arched reflective canopy 102. The end panels 114 may be secured to the frame 106 and/or the arcuate edge of the bendable reflective canopy 102 by any suitable fixing elements, such as clips, screws, etc.

The end panels 114 may be translucent or opaque and may be formed of any suitable material depending on whether the end panels 114 are desired to be optically transmissive or otherwise. Suitable materials include metals (e.g. aluminium), metal alloys (e.g. steel) and polymers. The surface of the end panels 114 facing the interior of the luminaire may, for instance, may be formed of, or may be coated with, a suitable reflective material, e.g. a glass, metal, mineral, and the like, in order to assist in redirecting light towards the light exit window.

In an embodiment, the luminaire may be a troffer which may be employed as a panel in a modular ceiling. Such a ceiling typically comprises a plurality of panels that can be suspended in a modular frame which may, for instance, be formed from a plurality of interconnected frame elements, e.g. strips. In such a modular ceiling, the luminaires may form or replace at least some of the panels in order to provide ceiling lighting. Luminaires in the form of troffers are particularly preferred in such modular ceilings.

In such an embodiment, the frame 106 and the bendable reflective canopy 102 may be dimensioned such that the luminaire, when assembled, fits into a ceiling recess. Accordingly, the width and length dimensions of the frame 106 may be such, for instance, as to match those of a panel of the modular ceiling. The area of such panels tends to be standardized (e.g. 60 cm by 60 cm or 60 cm by 120 cm). Of course, other dimensions for the ceiling panel or recess and thus the frame 106 are conceivable. The luminaire may, for example, be recessed into a plenum area above the modular ceiling. Accordingly, the depth of the luminaire, which may be partly determined by the degree of bending of the reflective canopy 102, may mean that it may fit into the plenum area above the modular ceiling such that, for instance, the luminaire does not protrude from the modular ceiling into the room below.

When the luminaire is intended for use as a troffer and thus is to be fitted into a recess of a suspended ceiling as described above, the end panels 114 may prevent users from observing the plenum area above the suspended ceiling through a gap between the frame 106 and the highest point of the arc shape of the reflective canopy 102.

The assembled luminaire may be mounted in the modular ceiling by employing a hook, lip or other means of engaging with an element of the ceiling recess. The end panels 114 may, for instance, comprise mounting members 130 for this purpose. As shown in FIG. 4, the end panels 114 may each comprise a pair of mounting members 130. The mounting members 130 may, for instance, be positioned on opposite ends of each end panel 114. The assembled luminaire may thus be mounted via the four mounting members 130, i.e. of both end panels 114. Alternatively or additionally, edges of the frame 106, e.g. edges of the respective side sections 108, 109, may respectively engage with, and be at least partially supported by, portions of opposing frame elements which delineate a panel of the modular ceiling. Other alternatives such as mounting the luminaire via mounting appendages fixed to the bendable reflective canopy 102 may also be contemplated.

Alternatively, the assembled luminaire may be suspended from a ceiling as a pendant luminaire. In such an example, end panels 114 may not be required in the kit 100, i.e. since the luminaire is not intended to be employed as a panel of a modular ceiling.

In an embodiment, each end panel 114 may comprise one of the further side sections 109. In other words, the frame 106 may not be supplied in the kit 100 as a fixed, or pre-assembled frame 106, but rather the frame 106 is assembled by the end user. In such an embodiment, this assembly may involve fixing the opposing side sections 108 to the further side sections 109 which are included in the end panels 114, thereby simultaneously assembling the frame 106 and affixing the end panels 114 to the frame 106. The end panels 114 may be pre-fixed to the further side sections 109 by any suitable means, such as using screws, clips etc. Alternatively, the end panels 114 and further side sections 109 may be formed as one article, e.g. by any suitable casting, extruding or molding technique or the like.

The end panels 114 may also assist to support the bent reflective canopy 102 when the luminaire is assembled. The arc-shaped surfaces of the end panels 114 may support the arched reflective canopy 102 by, for instance, the arched reflective canopy 102 contacting, and optionally being adhered to, the arc-shaped surfaces.

The kit 100 may optionally further comprise a louver or diffuser (not shown) which may assist to reduce glare and thus may improve the quality of the lighting provided by the luminaire. The louver or diffuser may be attached to the frame 106 by any suitable fastenings, such as clips, screws and the like.

Figure 5:
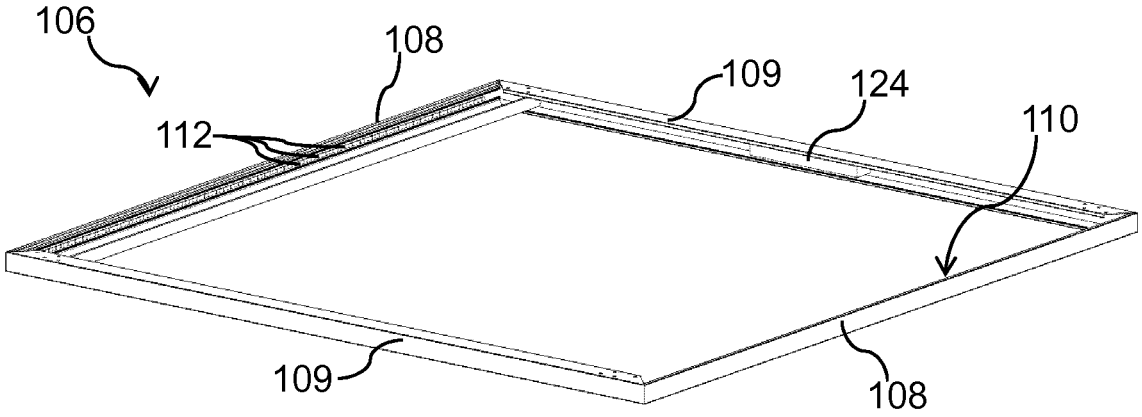
FIG. 5 shows the frame of the kit shown in FIG. 3.

The frame 106 will now be described in more detail with reference to FIG. 5. Whilst the shape of the frame 106 depicted in the Figures is square or rectangular, this is not intended to be limiting and other, e.g. polygonal, shapes may also be contemplated. As shown in FIG. 5, the opposing side sections 108 are spaced apart by the further side sections 109. Whilst the further side sections 109 are shown as extending linearly between the opposing side sections 108, alternative shapes for the frame 106 may, for instance, be attained by the further side sections 109 being angled or curved, as will be readily appreciated by the skilled person. The opposing side sections 108 each comprise an engagement member 110 for engaging with an edge portion 104 of the bendable reflective canopy 102, as described above.

The frame sections, e.g. the respective side sections 108, 109, comprise solid state lighting elements 112. The solid state lighting element 112 may be, for example, a light emitting diode (LED). In an embodiment, the solid state lighting elements 112 may be grouped in at least one row. Each row may extend across one of the side sections 108, 109. In this way, the solid state lighting elements 112 are arranged in a spatially efficient manner thereby assisting the luminaire to provide the desired luminous output and uniformity of lighting.

Whilst in FIG. 5 the solid state lighting elements 112 are shown as being mounted on one of the opposing side sections 108, this is not intended to be limiting. The solid state lighting elements 112 may, for instance, be mounted on both opposing side sections 108 thereby illuminating the bendable reflective canopy 102 from opposite directions when the luminaire is assembled.

When the solid state lighting elements 112 are mounted on at least one the opposing side sections 108, part of their luminous output may be aimed at a portion of the arched reflective canopy 102 which is curving downwardly towards the opposite side section 108. This portion may effectively redirect, i.e. reflect, light emitted by these solid state lighting elements 112 towards the light exit window. Alternatively or additionally, the solid state lighting elements 112 may be mounted on one or both of the further side sections 109.

Each solid state lighting element 112 is mounted such that when the luminaire is assembled at least a part of its luminous output is redirected by the bendable reflective canopy 102 towards the light exit window. In this way, the luminaire provides an indirect lighting effect, as previously described.

In an embodiment, each solid state lighting element 112 may be arranged such that, when the luminaire is assembled, a first part of its luminous output is redirected by the bendable reflective canopy 102 towards the light exit window, and a second part of its luminous output is aimed at the light exit window. Accordingly, the luminaire may provide both indirect and direct lighting, similarly to the side-lit luminaire 70 shown in FIG. 2. This may be achieved by, for example, the optical axis of each solid state lighting element 112 being in a plane defined by the light exit window of the luminaire. The angular distribution of the luminous output may thus be distributed at angles either side of the optical axis. In this way, the first part of the luminous output may correspond to a portion of the angular distribution aiming towards the bendable reflective canopy 102 and the second part may correspond to a further portion of the angular distribution which is directed towards the light exit window.

Alternatively, the solid state lighting elements 112 may be mounted on the frame 106 such that they face the bendable reflective canopy 102. In such an embodiment, the majority or the entirety of the luminous output of the solid state lighting elements 112 may be redirected by the bendable reflective canopy 102 towards the light exit window. Other mounting geometries for the solid state lighting elements 112 are also conceivable.

Whilst not visible in FIG. 5, the frame 106 may comprise an optical element mounted over each of the rows of solid state lighting elements 112. The optical element may comprise a lens strip adapted to guide, i.e. refract, light emitted by the solid state lighting elements 112 towards the bendable reflective canopy 102. The lens strip may be formed of any suitable optical material such as glass, PMMA, polycarbonate etc.

Alternatively or additionally, the optical element may comprise a diffuser strip for combining and homogenizing the luminous output of each of the solid state lighting elements 112 such that a uniform lighting effect extends across the row. The diffuser strip may comprise any suitable material such as a polymer, e.g. a clouded or translucent polymer. Thus the areas or spaces between the solid state lighting elements 112 in the row may be rendered less noticeable and glare may be lessened. The diffuser strip may accordingly improve the perceived quality of the direct lighting effect when the solid state lighting elements 112 are arranged to aim part, i.e. the second part, of their luminous output towards the light exit window.

The solid state lighting elements 112 may, for instance, be mounted directly on the frame 106. This may be achieved by, for instance, using a glue or adhesive strip. In an example, the glue or adhesive strip may be thermally conducting such that dissipation of the heat generated by the solid state lighting elements 112 to the frame 106 may be assisted.

Alternatively, the solid state lighting elements 112 may, for instance, be mounted on a printed circuit board (PCB) which may be fixed to the frame 106. For example, each side section 108, 109 which carries the solid state lighting elements 112 may comprise a separate PCB on which the solid state lighting elements 112 may be mounted. In order to assist heat dissipation, the PCB may, for instance, be fixed to the side section 108, 109 using a thermally conductive glue or adhesive strip(s). PCBs, and means of mounting solid state lighting elements 112 on them, are well-known per se and will not be further described herein for the sake of brevity only.

Each solid state lighting element 112 may, for example, be configured to emit light with a particular spectral composition, i.e. colour. In a non-limiting example, at least two of the solid state lighting elements 112 may be adapted to emit light of different colour with respect to each other. The at least two solid state lighting elements 112 may, for instance, be dimmable and/or may be able to produce an output having a configurable spectral composition, e.g. a white light output having a configurable colour temperature, e.g. a colour temperature ranging from about 2,000 to about 8,000 K, e.g. from about 2,500 K to about 6,500 K, and/or a configurable coloured output having a spectral composition having a central spectral component ranging from 400 nm to 700 nm for example. The luminaire may achieve a configurable luminous output in any suitable manner: for example, by each individual solid state lighting element 112 being able to produce such a configurable spectral composition or by a plurality of individually controllable solid state lighting elements 112 producing outputs of different spectral compositions, and positioned such that respective luminous outputs are mixed to form light of a desired spectral composition, e.g. white light.

In a non-limiting example, the spectral composition provided by the luminaire comprising different colour-emitting solid state lighting elements 112 may be homogenized (i.e. colour-mixed) by employing a bendable reflective canopy 102 comprising a reflective surface which is at least partially diffusively reflective.

More generally, where the solid state lighting elements 112 are capable of generating different spectral compositions relative to each other, the solid state lighting elements 112 may be individually addressable such that a selection of solid state lighting elements 112 may be engaged to produce an output of a desired spectral composition.

The kit 100 and/or the luminaire may comprise a driver 124 configured to regulate power supplied to the solid state lighting elements 112. The driver 124 may be isolated or non-isolated. Drivers for solid state lighting elements are well-known per se and will not be further described herein for the sake of brevity only.

The driver 124 may, for instance, be included in the frame 106. Whilst in FIG. 5 the driver 124 is shown as being mounted on one of the further side sections 109, this is not intended to be limiting. Alternatively, the driver 124 may be mounted on one of the opposing side sections 108. If two drivers 124 are employed in the luminaire, e.g. for regulating the power supplied to respective rows of solid state lighting elements 112 mounted on different side sections 108, 109, the two drivers 124 may be mounted both on the same side section 108, 109 or each on different side sections 108, 109. In a non-limiting example, the solid state lighting elements 112 may be mounted in rows on both opposing side sections 108, and the driver or drivers 124 may be mounted on the further side section(s) 109. The driver 124 may be mounted on the frame 106 using any suitable means such as clips, screws, glue, adhesive strips etc. In order to assist dissipation of heat generated by the driver 124 to the frame 106, the driver 124 may be attached to the frame 106 using, for instance, a thermally conductive glue or adhesive strip(s).

Alternatively, the driver 124 may be mounted elsewhere in the luminaire, such as on an end panel 114, providing the kit 100 includes end panels 114. The driver 124 may instead be positioned separately from the luminaire. Electrical wiring running between the driver 124 and side sections 108, 109 carrying the solid state lighting elements 112 may be used to connect the driver 124 to the solid state lighting elements 112.

Figure 6:
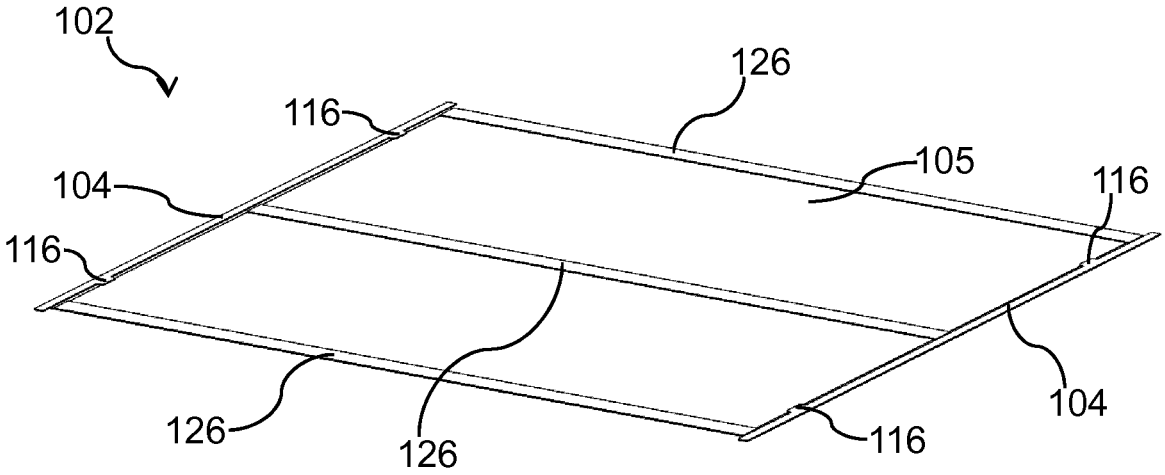
FIG. 6 shows a perspective view of the bendable reflective canopy of the kit shown in FIG. 3 in an unbent state.

FIG. 6 shows a perspective view of the bendable reflective canopy 102 in an unbent state. The unbent state may be substantially flat in order to assist with storing and transporting the bendable reflective canopy 102, as previously described.

The bendable reflective canopy 102 may comprise a bendable non-reflective material, such as a polymer film, a paper sheet, or a textile sheet. The bendable non-reflective material may carry a reflective material 105, such as in the form of a reflective coating. The reflective coating and the quantity applied to the bendable non-reflective material may be such as to avoid excessive stiffening of the bendable non-reflective material. Such a reflective coating is not especially limited and may, for instance, comprise a glass, metal, mineral, and the like. Inclusion of a mineral, such as $TiO_2$, into the reflective coating may assist the reflective material 105 to provide diffuse reflectance. Reflective materials/coatings are well-known per se and will not be further described herein for the sake of brevity only. Alternatively, the reflective material 105 may be both bendable and reflective, e.g. a polymer film or a metal foil. It's preferable that the bendable material can be bent without breaking under a force, but when the force is remove, it can rebound back because of its inherent resilience. This feature of resilience is particular useful to shape the arch over the light exit window, and the engagement of the canopy with the frame which will be described in detail with FIGS. 8 and 9.

The use of a light-weight material for the bendable reflective canopy 102 (e.g. a polymer film, a paper sheet, or a textile sheet) may also assist in reducing the weight of the kit 100 such that it may be more easily and cheaply transported.

In an embodiment, the bendable reflective canopy 102 comprises a plurality of spatially separated bendable support ribs 126 for supporting the bendable reflective canopy 102. Each of the bendable support ribs 126 may extend between the pair of opposing edge portions 104. The bendable support ribs 126 may extend along further edges of the bendable reflective canopy 102 which extend between the opposing edge portions 104. A bendable support rib 126 may also extend across a central portion of the bendable reflective canopy 102, as shown in FIGS. 6 and 7.

The bendable support ribs 126 may support the reflective material 105 of the bendable reflective canopy 102 and increase the strength of the bendable reflective canopy 102, particularly when the reflective canopy 102 is bent, i.e. when the luminaire is, or is being, assembled. In other words, the bendable support ribs 126 reinforce the reflective canopy 102 and provide additional resilience such that it can better withstand the bending required to form the arched shape over the light exit window of the luminaire. The bendable support ribs 126 may be formed of any suitable material such as a bendable metal or plastic and may be secured to the bendable reflective canopy 102 using any suitable means such as using an adhesive, rivets etc.

Figure 7:
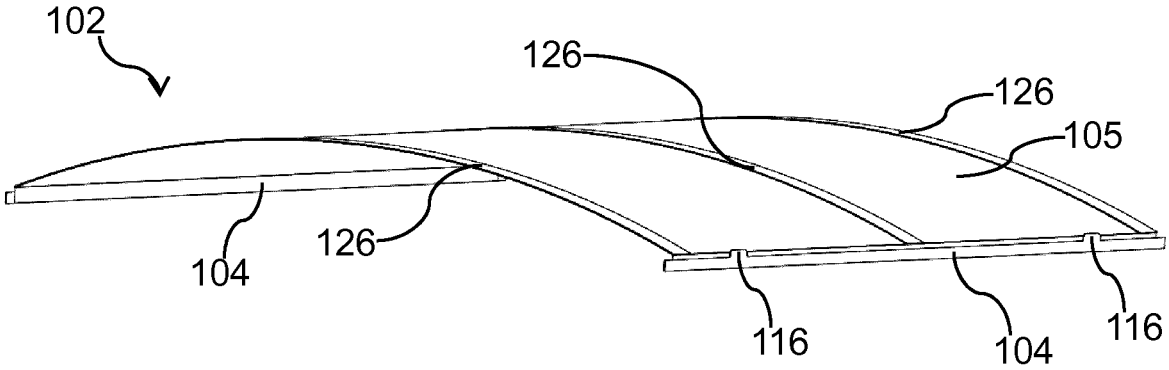
FIG. 7 shows a perspective view of the bendable reflective canopy of the kit shown in FIG. 3 in a bended state.

The arched shape of the bent reflective canopy 102 is shown in FIG. 7. The bending of the reflective canopy 102 permits engagement of the edge portions 104 with the respective engagement members of the opposing side sections 108 of the frame (not shown in FIG. 7), as previously described. The edge portions 104, as shown in FIGS. 6 and 7, may comprise metal or plastic strips which may further assist to support the reflective material 105 of the bendable reflective canopy 102. The metal or plastic strips may be attached to the bendable reflective canopy 102 using any suitable means such as an adhesive, rivets etc. Alternatively, the edge portions 104 may be formed of the same material as the reflective material 105.

Figure 8:
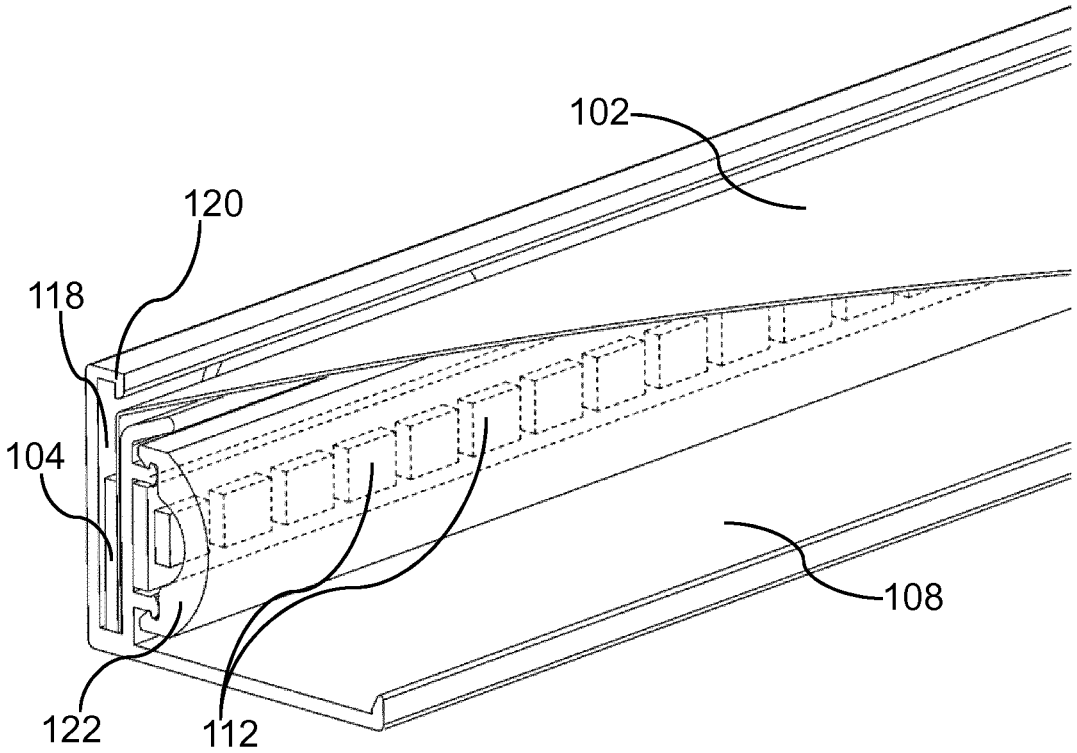
FIG. 8 shows a cut-away of the assembled luminaire shown in FIG. 4.

FIG. 8 shows a cut-away of the assembled luminaire shown in FIG. 4. Specifically, FIG. 8 depicts a portion of one of the opposing side sections 108. It is evident from FIG. 8 that the side sections 108, 109 may be made of right-angled sections, i.e. comprising two plate-like portions which are perpendicular to each other. The solid state lighting elements 112 may be mounted on the plate-like portion which is perpendicular to plane of the light exit window. By mounting the solid state lighting elements 112 in this way, parts of their luminous output may be directed both at the bendable reflective canopy 102 and the light exit window when the luminaire is assembled, as previously described. Directing light towards the bendable reflective canopy 102 may be assisted by the optical element 122 shown in FIG. 8 which in this example comprises a lens strip.

The plate-like portion which aligns with the plane of the light exit window may be employed to carry a driver (not visible in FIG. 8) for regulating power supplied to the solid state lighting elements 112, as previously described. Right-angled sections may be fabricated by, for instance, metal, e.g. aluminium, extrusion processes. Other possibilities for the frame sections, such as box section or flat bar etc. will be immediately apparent to the skilled person.

In an embodiment, the engagement member 110 which receives the edge portion 104 may be a fastening member such that the edge portion 104 can be secured to the frame 106. This securing may be achieved by the edge portion 104 comprising a further fastening member for engaging with one of the fastening members. The fastening member and further fastening member may involve any suitable coupling mechanism, such as hooks and eyes, buckle clips etc.

In the example shown in FIG. 8, the fastening member comprises an elongate channel 118 which extends across the side section 108. A hooked member 120 opposes the channel 118. The edge portion 104 is received into the elongate channel 118 by inserting the edge portion 104 into an opening of the channel 118. In this example, the edge portion 104 comprises a metal or plastic strip which has a further fastening member in the form of protrusions 116, one of which is shown in the cutaway view provided in FIG. 9. The protrusions 116 extend outwardly from the edge portion 104 and are received into the hooked member 120 when the edge portion 104 is received in the elongate channel 118. The hooked member 120 has a lip which prevents the edge portion 104 from slipping out of the elongate channel. Here the protrusions 116 act as a barb of an arrow or spear to make the edge portion 104 easy to be inserted into but hard to be removed from the elongate channel 118.

Figure 9:
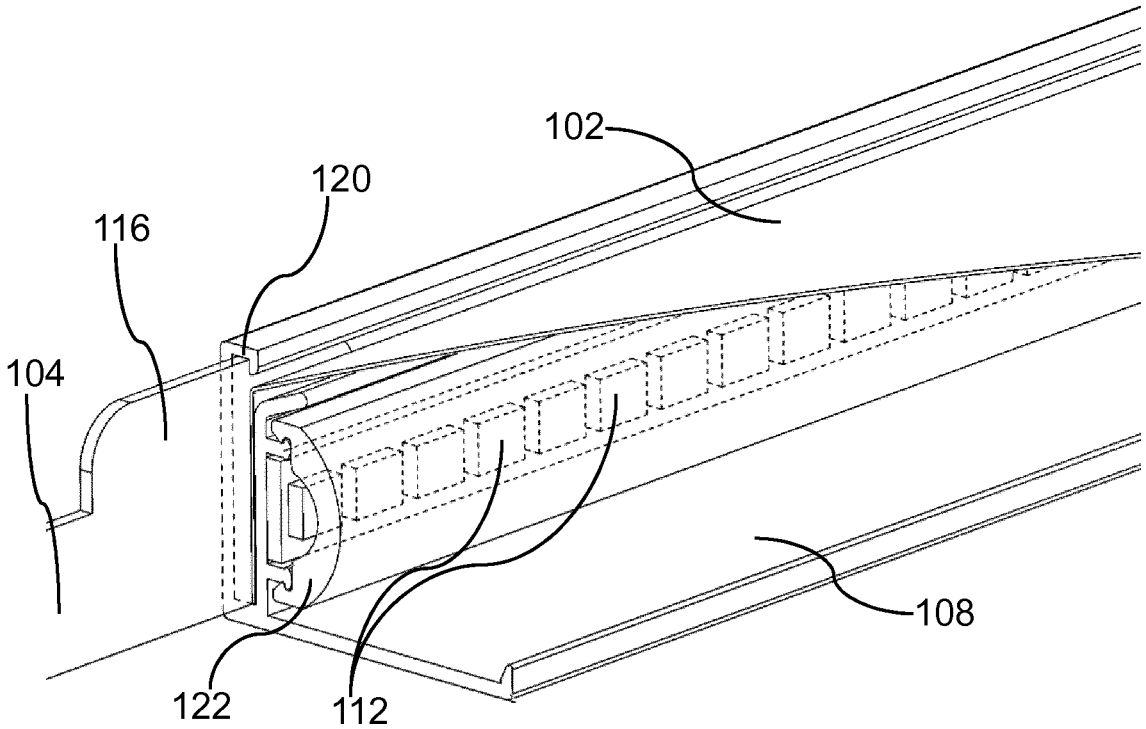
FIG. 9 shows a further cut-away of the assembled luminaire shown in FIG. 4.

As shown in FIG. 9, the combined height of the edge portion 104 and the protrusion 116 is substantially equal to, or in practice slightly smaller than, the distance between the bottom of the elongate channel 118 and the receiving surface of the hooked member 120. Accordingly the dimensions of the respective fastening members ensure that the edge portion 104 is secured to the side section 108 when the luminaire is assembled. Because the elongate channel 108 is at an angle with respect to the direction of the canopy 102, the resilience of the bendable canopy material is particular helpful to secure the engagement between the protrusion 116 and the hooked member 120.

Alternatively, the kit 100 may additionally comprise fasteners, such as clips, for securing the edge portions 104 when they are engaged with the respective engagement members 110.

Figure 10:
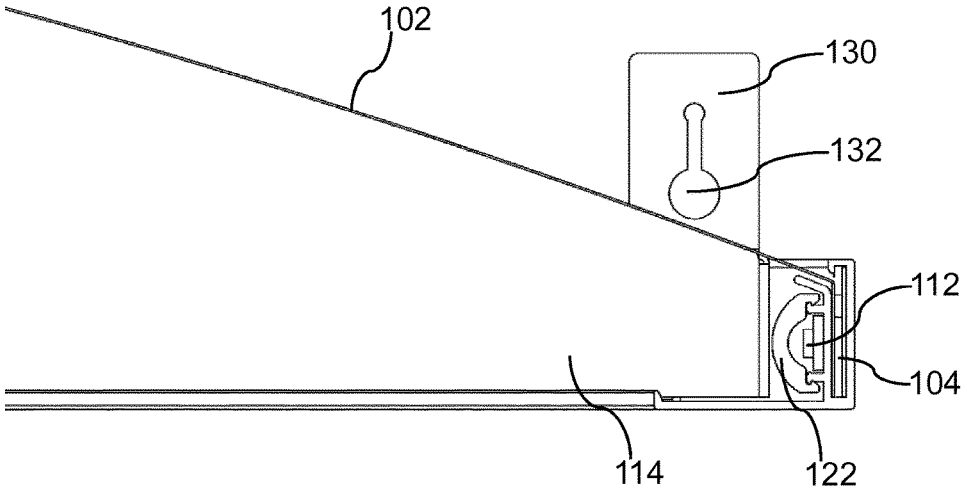
FIG. 10 shows a partial cross-section of the assembled luminaire shown in FIG. 4.

FIG. 10 shows a partial cross-section of the assembled luminaire shown in FIG. 4. The edge portion 104 of the bendable reflective canopy 102 is shown as being located and secured into the elongate channel 118, as described above in relation to FIGS. 8 and 9. The side profile of the optical element 122, in this case a lens strip, is shown extending over the luminous surfaces of the solid state lighting elements 112. The inner surface of the lens strip curves over the solid state lighting elements 112, as shown in FIG. 10. The outer surface curves in the same manner as the inner surface. The refractive properties of the lens strip may thus assist to guide light towards the bendable reflective canopy 102 when the luminaire is assembled.

The partial cross-section of FIG. 10 further shows the end panel 114 and one of the mounting members 130. The mounting member 130 delimits an aperture 132 which may receive a screw, nail, bolt etc. such that the assembled luminaire can secured to a suitable supporting structure, e.g. in a recessed area of a modular ceiling.

Figure 11:
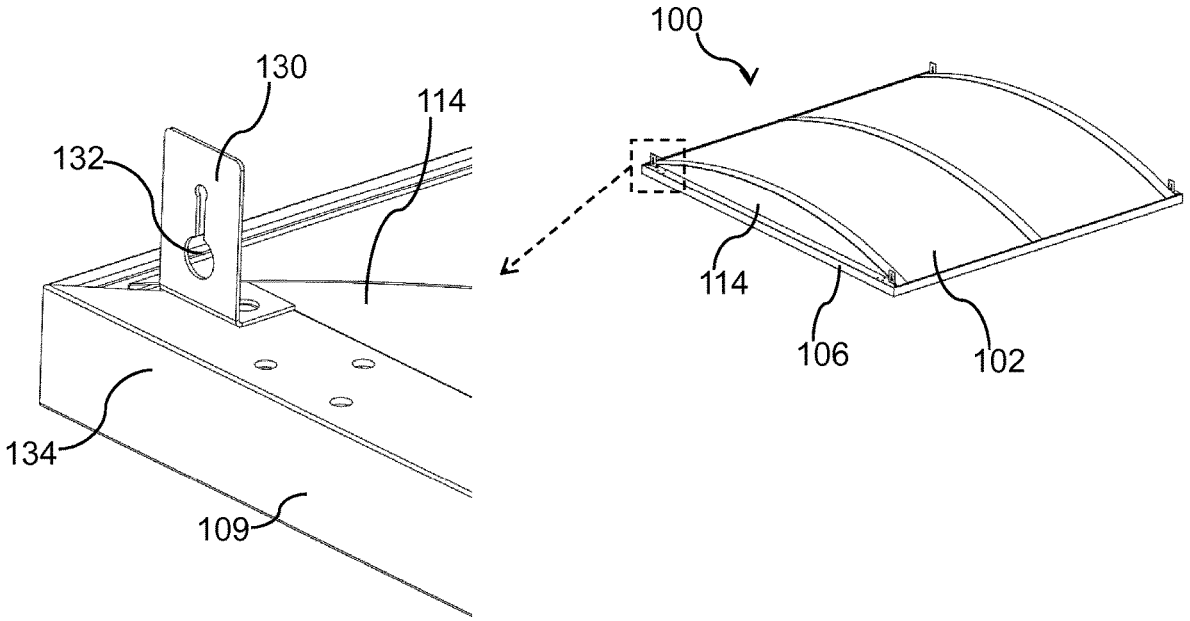
FIG. 11 shows the assembled luminaire shown in FIG. 4 together with an expanded view of a corner portion of the luminaire.
Figure 12:
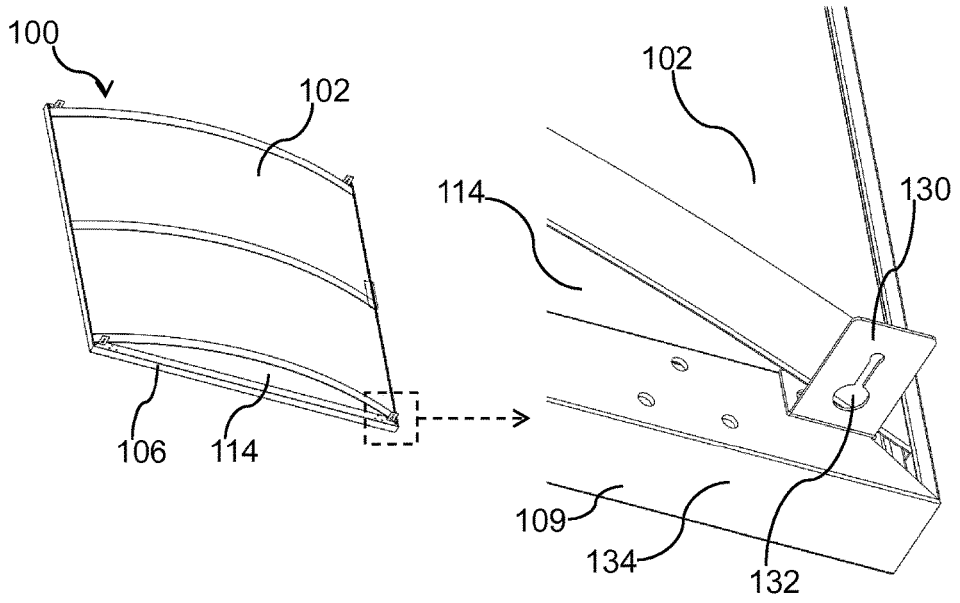
FIG. 12 shows the assembled luminaire shown in FIG. 4 together with an expanded view of another corner portion of the luminaire.
Figure 13:
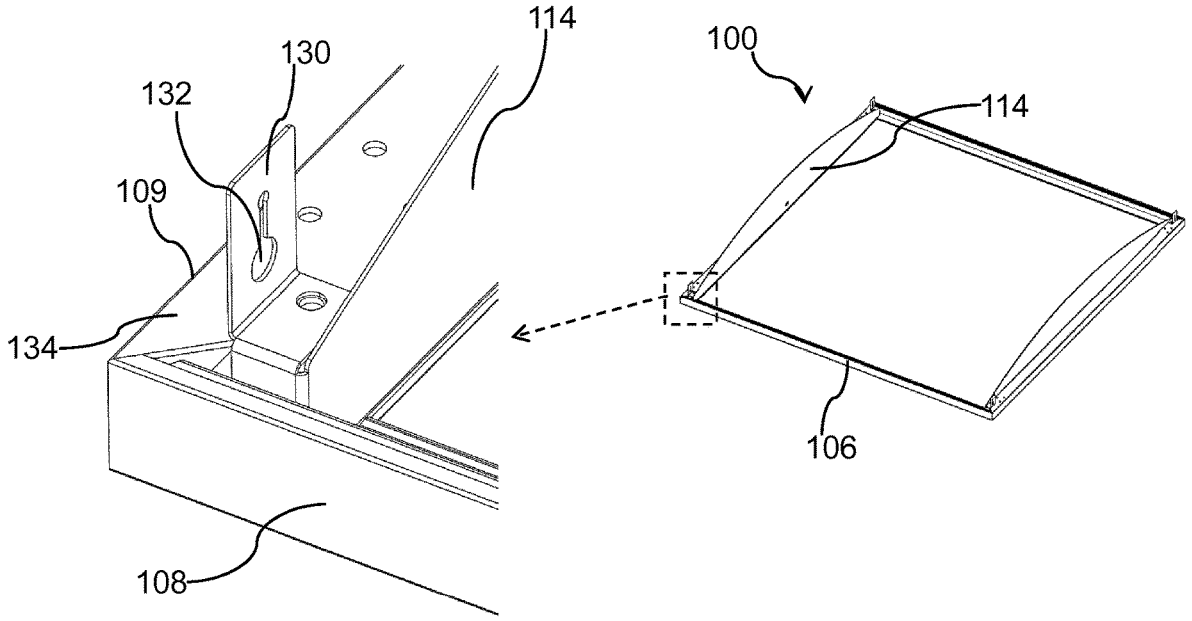
FIG. 13 shows the assembled luminaire shown in FIG. 4 together with an expanded view of a further corner portion of the luminaire.

FIGS. 11-13 provide various views of the corner portions of the assembled luminaire. The end panel 114 may be attached to a further right-angled section 134. The further right-angled section 134 may then contact, i.e. engage with, right-angled outer surfaces of the further side section 109. This may assist to align the end panel 114 before it is secured to the further side section 109. As noted above, it is also possible for the end panel 114 to include the further side section 109, i.e. when the frame 106 is supplied as frame sections to be assembled by the end user.

The lighting provided by the luminaire may be controlled by a controller. Such control systems employing a controller to control a luminaire or a plurality of luminaires are well-known per se. When a plurality of luminaires are employed, the controller may be configured to provide a control signal for controlling each individual luminaire or alternatively may be configured to provide a single control signal for controlling several luminaires. The controller may, for example, be operated by a user and/or may provide automatic control over the luminaire(s). Such automatic control may, for example, be based on a preset lighting routine or sensory input. For example, the controller may be adapted to adjust at least one of a dimming level and the spectral composition of the luminous output of the luminaire, in response to a sensor signal. Alternatively or additionally, the controller may increase or decrease the number of light sources 112 being switched on in response to such a sensor signal. Other suitable sensor-controlled adjustments to the luminous output of the luminaire will be immediately apparent to the skilled person. The controller may be responsive to a user-generated control signal, e.g. provided via a wall-mounted switch or via a remote controller, which may be a dedicated remote controller or an electronic device configured by an app or the like to provide such remote control functionality. To this end, the luminaire may comprise a wireless communication module through which the controller may receive such control instructions using any suitable wireless communication protocol.

Figure 14:
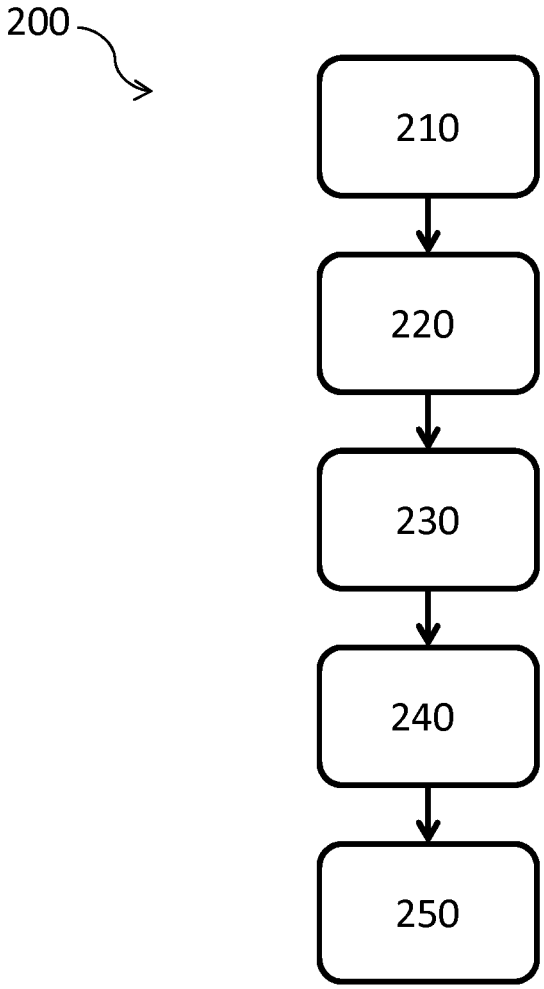
FIG. 14 shows a flowchart of a method of assembling the luminaire according to an embodiment.

FIG. 14 shows a flowchart of a method 200 of assembling the luminaire using the kit. The method 200 commences in step 210. Step 210 may be considered as the step of providing the kit. Subsequently, step 220 comprises engaging an edge portion of the bendable reflective canopy with an engagement member located on a side section of the frame. Step 230 involves bending the bendable reflective canopy such that it arches over the light exit window. In step 240, a further edge portion which opposes the edge portion is engaged with a further engagement member located on a further side section which opposes the side section. The method terminates in step 250.

The bending step 220 may be performed before the engagement steps 220 and 240, providing the bent shape of the bendable reflective canopy can be maintained, i.e. without being attached to the frame. Alternatively, one of the edge portions can be engaged 220 before bending 230 of the bendable reflective canopy and subsequent engaging 240 of the other edge portion.

When the kit comprises end panels, these may be attached to the frame before or after attaching the bendable reflective canopy. When the end panels assist in supporting the bendable reflective canopy, the end panels may be attached to the frame before attachment of the bendable reflective canopy.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A kit for assembling a luminaire by an end user, comprising:

a bendable reflective canopy extending between a pair of opposing edge portions;

a plurality of frame sections for defining a frame delimiting a light exit window of the luminaire, the frame sections including a pair of opposing side sections and a pair of further side sections for spacing the opposing side sections, each of said opposing side sections comprising an engagement member for engaging with one of said edge portions when assembling the luminaire, wherein the opposing side sections are spaced by the further side sections such that the reflective canopy arches over the light exit window when the edge portions are engaged with said engagement members; and a plurality of solid state lighting elements, wherein each solid state lighting element is mounted on one of said side sections such that when the luminaire is assembled at least a part of its luminous output is redirected by said bendable reflective canopy towards the light exit window;

wherein the engagement member is a fastening member, each edge portion further comprising a further fastening member for engaging with one of said fastening members; the further fastening member comprises at least one protrusion which protrudes from said edge portion, and the fastening member comprises an elongate channel dimensioned to receive one of said edge portions, and a hooked member opposing said channel for receiving and securing said at least one protrusion when the edge portion is received in said elongate channel; and wherein the bendable reflective canopy comprises a plurality of spatially separated bendable support ribs for supporting said canopy, each of said support ribs extending between the pair of opposing edge portions.

2. The kit of claim 1, wherein each solid state lighting element is arranged such that, when the luminaire is assembled, a first part of its luminous output is redirected by said bendable reflective canopy towards the light exit window, and a second part of its luminous output is aimed at the light exit window.

3. The kit of claim 1, wherein the kit further comprises a pair of end panels, each end panel being shaped to cover a gap delimited by one of said further side sections and an arcuate edge of said arched reflective canopy when the luminaire is assembled, wherein said end panels are translucent or opaque.

4. The kit of claim 3, wherein each end panel comprises one of said further side sections.

5. The kit of claim 1, wherein said bendable reflective canopy is supplied in an unbent state.

6. The kit of claim 1, wherein the plurality of frame sections define a fixed frame.

7. The kit of claim 1, wherein the solid state lighting elements) are grouped in at least one row, each row extending across one of said side sections.

8. The kit of claim 7, wherein the frame comprises an optical element mounted over each of said rows.

9. The kit of claim 8, wherein the optical element comprises a diffuser strip or a lens strip.

10. The kit of claim 1, wherein the luminaire is a troffer and the frame and arched reflective canopy are dimensioned to fit into a ceiling recess when said luminaire is assembled.

11. A method of assembling a luminaire using the kit of claim 1 comprising:

engage one of the edge portions of the bendable reflective canopy with the engagement member located on the side section of the frame, wherein the hooked member receives and secures the at least one protrusion when the edge portion is received in the elongate channel;

bending the bendable reflective canopy such that it arches over said light exit window; and engaging the further edge portion which opposes said edge portion with the further engagement member located on the further side section which opposes said side section, wherein the hooked member receives and secures the at least one protrusion when the edge portion is received in the elongate channel.

12. A luminaire assembled from the kit of claim 1.

13. A modular ceiling kit comprising the kit of claim 1 of the assembled luminaire.

* * * * *